US005449970A

United States Patent [19]

Kumar et al.

[11] Patent Number: 5,449,970

[45] Date of Patent: Sep. 12, 1995

[54] DIODE STRUCTURE FLAT PANEL DISPLAY

[75] Inventors: Nalin Kumar, Austin; Chenggang Xie, Cedar Park, both of Tex.

[73] Assignee: Microelectronics and Computer Technology Corporation, Austin, Tex.

[21] Appl. No.: 995,846

[22] Filed: Dec. 23, 1992

Related U.S. Application Data

[63] Continuation-in-part of Ser. No. 851,701, Mar. 16, 1992, abandoned.

[51] Int. Cl.[6] ..... H01J 1/30

[52] U.S. Cl. ..... 313/495; 313/496; 313/309; 313/351; 313/292; 315/169.4; 345/75

[58] Field of Search ..... 313/495, 496, 309, 310, 313/311, 336, 351, 355, 250, 253, 257, 258, 268, 292; 315/169.4; 345/37, 60, 47, 74, 75

[56] References Cited

U.S. PATENT DOCUMENTS

| | | | |
|---|---|---|---|
| 3,947,716 | 3/1976 | Fraser, Jr. et al. | 313/336 |
| 3,970,887 | 7/1976 | Smith et al. | 313/309 |
| 4,008,412 | 2/1977 | Yuito et al. | 313/309 |
| 4,075,535 | 2/1978 | Genequand et al. | 313/422 |
| 4,139,773 | 2/1979 | Swanson | 313/351 |
| 4,164,680 | 8/1979 | Villalobos | 313/336 |
| 4,307,507 | 12/1981 | Gray et al. | 313/309 X |
| 4,350,926 | 9/1982 | Shelton | 313/455 |
| 4,498,952 | 2/1985 | Christensen | 313/309 X |
| 4,578,614 | 3/1986 | Gray et al. | 313/309 |
| 4,588,921 | 5/1986 | Tischer et al. | 313/495 |
| 4,594,527 | 6/1986 | Genovese | 313/495 |
| 4,663,559 | 5/1987 | Christensen | 313/336 |
| 4,684,353 | 8/1987 | deSouza | 313/511 |
| 4,685,996 | 8/1987 | Busta et al. | 156/628 |

(List continued on next page.)

FOREIGN PATENT DOCUMENTS

| | | |
|---|---|---|
| 2608842 | 12/1986 | France . |
| 2663462 | 6/1990 | France . |

OTHER PUBLICATIONS

Noer, Electron Field Emission from Broad-Area Electrodes, *Applied Physics* A 28, 1982, pp. 1–24.

Avakyan et al., Angular Characteristics of the Radiation by Ultrarelativistic Electrons in Thick Diamond Single Crystals, *Soviet Technical Physics Letters*, vol. 11, No. 11, Nov. 1985, pp. 574–575.

Djubua et al., Emission Properties of Spindt-Type Cold Cathodes with Different Emission Cone Material, *IEEE Transactions on Electron Devices*, vol. 38, No. 10, Oct. 1991.

Wang et al., Cold Field Emission from CVD Diamond Films Observed in Emission Electron Microscopy, *Electronics Letters*, vol. 27, No. 16, Aug. 1991.

Geis et al., Diamond Cold Cathode, *IEEE Electron Devices Letters*, vol. 12, No. 8, pp. 456–459, Aug. 1991.

Collins et al., Thin-Film Diamond, The Texas Journal of Science, vol. 41, No. 4, pp. 343–358, 1989.

(List continued on next page.)

*Primary Examiner*—Sandra L. O'Shea
*Assistant Examiner*—Ashok Patel
*Attorney, Agent, or Firm*—Winstead Sechrest & Minick

[57] ABSTRACT

A matrix-addressed diode flat panel display of field emission type is described, utilizing a diode (two terminal) pixel structure. The flat panel display includes a cathode assembly having a plurality of cathodes, each cathode including a layer of cathode conductive material and a layer of a low effective work-function material deposited over the cathode conductive material and an anode assembly having a plurality of anodes, each anode including a layer of anode conductive material and a layer of cathodoluminescent material deposited over the anode conductive material, the anode assembly located proximate the cathode assembly to thereby receive charged particle emissions from the cathode assembly, the cathodoluminescent material emitting light in response to the charged particle emissions. The flat panel display further includes the capability for selectively varying field emission between the plurality of corresponding light-emitting anodes and field-emission cathodes to thereby effect an addressable grey-scale operation of the flat panel display.

23 Claims, 5 Drawing Sheets

U.S. PATENT DOCUMENTS

| | | | |
|---|---|---|---|
| 4,710,765 | 12/1987 | Ohkoshi et al. | 340/781 |
| 4,721,885 | 1/1988 | Brodie | 313/309 |
| 4,728,851 | 3/1988 | Lambe | 313/309 |
| 4,763,187 | 8/1988 | Biberian | 313/309 |
| 4,788,472 | 11/1988 | Katakami | 313/496 |
| 4,835,438 | 5/1989 | Baptist et al. | 313/309 |
| 4,855,636 | 8/1989 | Busta et al. | 313/336 X |
| 4,857,161 | 8/1989 | Borel et al. | 313/309 |
| 4,857,799 | 8/1989 | Spindt et al. | 313/495 |
| 4,874,981 | 10/1989 | Spindt | 313/309 |
| 4,882,659 | 11/1989 | Gloudemans | 313/496 X |
| 4,899,081 | 2/1990 | Kishino et al. | 313/496 |
| 4,908,539 | 3/1990 | Meyer | 313/169.4 |
| 4,923,421 | 5/1990 | Brodie et al. | 445/24 |
| 4,933,108 | 6/1990 | Soredal | 252/518 |
| 4,940,916 | 7/1990 | Borel et al. | 313/306 |
| 4,964,946 | 10/1990 | Gray et al. | 313/309 X |
| 4,990,766 | 2/1991 | Simms et al. | 313/336 |
| 5,015,912 | 5/1991 | Spindt et al. | 313/495 |
| 5,036,247 | 7/1991 | Watanabe et al. | 313/496 |
| 5,038,070 | 8/1991 | Bardai et al. | 313/309 |
| 5,055,744 | 10/1991 | Tsuruoka | 313/497 X |
| 5,063,323 | 11/1991 | Longo et al. | 313/309 |
| 5,063,327 | 11/1991 | Brodie et al. | 313/309 |
| 5,075,591 | 12/1991 | Holmberg | 313/309 |
| 5,089,742 | 2/1992 | Kirkpatrick et al. | 313/351 |
| 5,103,144 | 4/1992 | Dunham | 313/336 |
| 5,103,145 | 4/1992 | Doran | 313/309 |
| 5,141,460 | 8/1992 | Jaskie et al. | 313/309 |
| 5,180,951 | 1/1993 | Dworsky et al. | 313/311 |
| 5,194,780 | 3/1993 | Meyer | 313/309 |
| 5,243,252 | 9/1993 | Kaneko et al. | 313/336 X |

OTHER PUBLICATIONS

Collins et al., Laser Plasma Source of Amorphic Diamond, *Appl. Physics Lett.,* vol. 54, No. 3, 16 Jan. 1989, pp. 216–218.

Heidingsfeldova et al., Rhodium Complexes as Catalysts for Hydrosilylation Crosslinking of Silicon Rubber, *Journal of Applied Polymer Science,* vol. 30, 1985, pp. 1837–1846.

Davanloo et al., Amorphic Diamond Films Produced by a Laser Plasma Source, *Journal of Appl. Physics,* vol. 67, No. 4, 15 Feb. 1990, pp. 2081–2087.

DIODE STRUCTURE FLAT PANEL DISPLAY

RELATED APPLICATION

This application is a continuation-in-part of Ser. No. 07/851,701, which was filed on Mar. 16, 1992, entitled "Flat Panel Display Based on Diamond Thin Films" now abandoned.

TECHNICAL FIELD OF THE INVENTION

This invention relates in general to flat panel displays for computers and the like and, more specifically, to such displays that are of a field emission type using a diode pixel structure in which the pixels are individually addressable.

BACKGROUND OF THE INVENTION

Conventional cathode ray tubes (CRTs) are used in display monitors for computers, television sets, and other video devices to visually display information. Use of a luminescent phosphor coating on a transparent face, such as glass, allows the CRT to communicate qualities such as color, brightness, contrast and resolution which, together, form a picture for the benefit of a viewer.

Conventional CRTs have, among other things, the disadvantage of requiring significant physical depth, i.e. space behind the actual display screen, resulting in such units being large and cumbersome. There are a number of important applications in which this physical depth is deleterious. For example, the depth available for many compact portable computer displays precludes the use of conventional CRTs. Furthermore, portable computers cannot tolerate the additional weight and power consumption of conventional CRTs. To overcome these disadvantages, displays have been developed which do not have the depth, weight or power consumption of conventional CRTs. These "flat panel" displays have thus far been designed to use technologies such as passive or active matrix liquid crystal displays ("LCD") or electroluminescent ("EL") or gas plasma displays.

A flat panel display fills the void left by conventional CRTs. However, the flat panel displays based on liquid crystal technology either produce a picture which is degraded in its fidelity or is non-emissive. Some liquid crystal displays have overcome the non-emissiveness problem by providing a backlight, but this has its own disadvantage of requiring more energy. Since portable computers typically operate on limited battery power, this becomes an extreme disadvantage. The performance of passive matrix LCD may be improved by using active matrix LCD technology, but the manufacturing yield of such displays is very low due to required complex processing controls and tight tolerances. EL and gas plasma displays are brighter and more readable than liquid crystal displays, but are more expensive and require a significant amount of energy to operate.

Field emission displays combine the visual display advantages of the conventional CRT with the depth, weight and power consumption advantages of more conventional flat panel liquid crystal, EL and gas plasma displays. Such field emission displays use very sharp micro-tips made of tungsten, molybdenum or silicon as the cold electron emitter. Electrons emitted from the cathode due to the presence of an electric field applied between the cathode and the grid bombard the phosphor anode, thereby generating light.

Such a matrix-addressed flat panel display is taught in U.S. Pat. No. 5,015,912, which issued on May 14, 1991, to Spindt et al., and which uses microtip cathodes of the field emission type. The cathodes are incorporated into the display backing structure, and energize corresponding cathodoluminescent areas on a face plate. The face plate is spaced 40 microns from the cathode arrangement in the preferred embodiment, and a vacuum is provided in the space between the plate and cathodes. Spacers in the form of legs interspersed among the pixels maintain the spacing, and electrical connections for the bases of the cathodes are diffused sections through the backing structure.

An attribute of the invention disclosed in Spindt et al. is that it provides its matrix-addressing scheme entirely within the cathode assembly. Each cathode includes a multitude of spaced-apart electron emitting tips which project upwardly therefrom toward the face structure. An electrically conductive gate or extraction electrode arrangement is positioned adjacent the tips to generate and control electron emission from the latter. Such arrangement is perpendicular to the base stripes and includes apertures through which electrons emitted by the tips may pass. The extraction electrode is addressed in conjunction with selected individual cathodes to produce emission from the selected individual cathodes. The grid-cathode arrangement is necessary in micro-tip cathodes constructed of tungsten, molybdenum or silicon, because the extraction field necessary to cause emission of electrons exceeds 50 Megavolts per meter ("MV/m"). Thus, the grid must be placed close (within approximately 1 micrometer) to the micro-tip cathodes. These tight tolerances require that the gate electrodes be produced by optical lithographic techniques on an electrical insulating layer which electrically separates the gates of each pixel from the common base. Such photolithography is expensive and difficult to accomplish with the accuracy required to produce such a display, thereby raising rejection rates for completed displays.

The two major problems with the device disclosed in Spindt et al. are 1) formation of the micro-tip cathodes and 2) formation and alignment of the extraction electrodes with respect to the cathodes. The structure disclosed in Spindt et al. is extremely intricate and difficult to fabricate in the case of large area displays. Thus, the invention disclosed in Spindt et al. does not address the need for a flat panel display which is less complicated and less expensive to manufacture.

The above-mentioned problems may be alleviated if the grid structure and sharp micro-tips are not needed. This may be accomplished by use of a flat cathode as the electron field emitter in a diode configuration where the anode is coated with a phosphor. No extraction grid is needed in such a display, thereby rendering the display relatively easy to construct.

Unfortunately, such field emission flat panel displays having a diode (cathode/anode) configuration suffer from several disadvantages.

First, the energy of electrons bombarding phosphors coating the anode is determined by the voltage between the cathode and the phosphors on the anode. In color displays, in which the phosphors must be excited by an especially high electron energy, cathode/anode voltage should be higher than 300 volts. This high voltage requirement causes cathode and anode drivers to be able to handle the higher voltage, thus making the drivers more expensive to manufacture. Such high voltage drivers are also relatively slow due to the time it takes to develop the higher voltage on conductors within the display.

According to Fowler-Nordheim ("F-N") theory, the current density of field emissions changes by as much as 10 percent when cathode/anode separation changes by only 1 percent. Prior art flat panel displays have not been completely successful in overcoming the problem of field emission variations.

All flat panel displays must employ an addressing scheme of some sort to allow information a computer or other device sends to the display to be placed in proper order. Addressing is simply the means by which individual display or picture elements (frequently called "pixels") are accessed and configured to display the information.

A related issue which must be addressed in the context of flat panel displays is proper spacing between anode and cathode assemblies. As has been discussed, proper spacing is critical in controlling field emission variation from one pixel to another and in minimizing the voltage required to drive the display. In triode displays, glass balls, fibers, polyimides and other insulators have been used to maintain proper separation. In such displays, separation is not as critical because the electric field between the anode and electron extraction grid is not as great (on the order of 10%) of the electric field between the grid and the cathode (the electron extraction field). In diode displays, a spacer must have a breakdown electric field much larger than the electron extraction field for the cathode.

To be useful in today's computer and video markets, flat panel displays must be able to create pictures having greys (half-tones) thereby allowing the displays to create graphical images in addition to textual images. In the past, both analog and duty-cycle modulation techniques have been used to implement grey-scale operation of a flat panel display.

The first of these is analog control. By varying voltage in a continuous fashion, individual pixels thus excited can be driven to variable intensities, allowing grey-scale operation. The second of these is duty-cycle modulation. One of the most often employed versions of this type of control is that of pulse-width modulation, in which a given pixel is either completely "on" or completely "off" at a given time, but the pixel is so rapidly switched between the "on" and "off" states that the pixel appears to assume a state between "on" and "off." If the dwell times in the "on" or "off" states are made unequal, the pixel can be made to assume any one of a number of grey states between black and white. Both of these methods are useful in controlling diode displays.

A matrix-addressable flat panel display which is simple and relatively inexpensive to manufacture and which incorporates redundancy for continued operation of each pixel within the display is required to overcome the above-noted disadvantages. The display should embody a sophisticated cathode/anode spacing scheme which is nonetheless reliable and inexpensive to manufacture. Finally, the display should also embody a scheme for implementing a grey scale mode within a flat panel display of diode pixel structure to allow individual pixels to assume shades between black and white, thereby increasing the information-carrying capacity and versatility of the display.

SUMMARY OF THE INVENTION

The present invention relates to a flat panel display arrangement which employs the advantages of a cathodoluminescent phosphor of the type used in CRTs, while maintaining a physically thin display. The flat panel display is of a field emission type using diode (two terminal) pixel structure. The display is matrix-addressable by using anode and cathode assemblies arranged in strips in a perpendicular relationship whereby each anode strip and each cathode strip are individually addressable by anode and cathode drivers respectively. Effectively, a "pixel" results at each crossing of an anode strip and a cathode strip. Both the anode strips and the cathode strips are isolated from one another to maintain their individual addressability. The result is that each pixel within the display may be individually illuminated.

The cathode assembly may be either a flat cathode or a set of micro-tips which may be randomly patterned or photo-lithographically patterned. The flat cathodes consist of a conductive material deposited over a substrate and a resistive material deposited over the conductive material. A thin film of low effective work function is then deposited over the resistive layer. In the preferred embodiment of the invention, the thin film is amorphic diamond. The cathode strips may be further subdivided to allow operation at a particular pixel site even if there is a failure in one of the divisions. The resistive layer, which may be constructed of high-resistivity diamond or similar materials, provides adequate isolation between the various subdivisions. These multiple subdivisions of a pixel may be implemented on either the anode or the cathode.

The anode assembly consists of a transparent conductive material such as indium-tin oxide (ITO) deposited over a substrate with a low energy phosphor, such as zinc oxide (ZnO), deposited over the conductive layer.

The resultant anode assembly and cathode assembly are assembled together with a peripheral glass frit seal onto a printed circuit board. The proper spacing is maintained between the two assemblies by spacers consisting of either glass fibers or glass balls or a fixed spacer produced by typical deposition technology. In the preferred embodiment of the invention, spacing is provided by a plurality of spacers disposed within holes formed in the cathode substrate so as to form a long surface path to thereby discourage leakage of current from the cathode to the anode by virtue of electron-induced conductivity. A vacuum is created within the space between the anode and cathode assemblies by removing gases via an exhaust tube. Systems for maintaining vacuums within such structures are well known in the art. Impurities within the vacuum are eliminated by a getter.

Individual rows and columns of anode strips and cathode strips are externally accessible by flexible connectors provided by typical semiconductor packaging technology. These connectors may be attached to anode and cathode drivers so as to provide the addressability of each pixel within the display.

An individual pixel is illuminated when the potential between portions of a cathode and anode strip corresponding to that pixel is sufficient to emit electrons from the cathode which then emanate toward the low energy phosphor material. Since such an emission of electrons requires a considerable amount of voltage, which requires additional circuitry to switch such a high voltage, a constant potential is provided between the anode and cathode assemblies that does not provide enough voltage for electron emission. The remaining voltage required to provide the threshold potential for electron emission between the anode and cathode assemblies is provided by voltage drivers attached to each anode and cathode strip. These voltage drivers may be known as anode drivers and cathode drivers, respectively.

A pixel is addressed and illuminated when the required driver voltage is applied to a corresponding anode strip and cathode strip resulting in emission of electrons from that portion of the cathode strip adjacent to the anode strip. Electrons are not emitted within a pixel area if only the corresponding anode strip, or corresponding cathode strip, are solely driven by the required driver voltage since the needed threshold potential between the anode and cathode is not achieved.

The present invention has the ability to implement the display in grey scale mode by either providing a variable voltage to individual pixels, by providing a modulated constant voltage (as in pulse-width modulation) or by subdividing each of the anode strips into strips of various widths which are individually addressable by the anode drivers. These individual strips may be addressed in various combinations resulting in activation of various amounts of light emitting phosphor material within a pixel by emitted electrons from the corresponding cathode.

Some of the advantages of the present invention include low power consumption, high brightness, low cost and low drive voltage. Additionally, the cathode assembly of the present invention is less complicated and less expensive to manufacture than micro-tip based triode displays since sophisticated photolithography is not required to produce a flat cathode arrangement.

Accordingly, it is a primary object of the present invention to provide a flat panel display comprising 1) a cathode assembly having a plurality of cathodes, each cathode including a layer of cathode conductive material and a layer of a low effective work-function material deposited over the cathode conductive material and 2) an anode assembly having a plurality of anodes, each anode including a layer of anode conductive material and a layer of cathodoluminescent material deposited over the anode conductive material, the anode assembly located proximate the cathode assembly to thereby receive charged particle emissions from the cathode assembly, the cathodoluminescent material emitting light in response to the charged particle emissions.

Another object of the present invention is to provide a display wherein a plurality of cathodes have a relatively flat emission surface comprising a low effective work-function material arranged to form a plurality of micro-crystallites.

A further object of the present invention is to provide a display wherein a plurality of cathodes have micro-tipped emission surfaces.

Still a further object of the present invention is to provide a display wherein a plurality of cathodes are randomly fabricated.

Yet another object of the present invention is to provide a display wherein a plurality of cathodes are photolithographically fabricated.

Another object of the present invention is to provide a display wherein micro-crystallites function as emission sites.

Still another object of the present invention is to provide a display wherein a low effective work-function material is amorphic diamond film.

And another object of the present invention is to provide a display wherein emission sites contain dopant atoms.

A further object of the present invention is to provide a display wherein a dopant atom is carbon.

Yet a further object of the present invention is to provide a display wherein emission sites have a different bonding structure from surrounding, non-emission sites.

Yet still another object of the present invention is to provide a display wherein emission sites have a different bonding order from surrounding, non-emission sites.

And still another object of the present invention is to provide a display wherein emission sites contain dopants of an element different from a low effective work-function material.

And another object of the present invention is to provide a display wherein emission sites contain defects in crystalline structure.

Yet another object of the present invention is to provide a display wherein defects are point defects.

Yet a further object of the present invention is to provide a display wherein defects are line defects.

Still a further object of the present invention is to provide a display wherein defects are dislocations.

Another primary object of the present invention is to provide a flat panel display comprising 1) a plurality of corresponding light-emitting anodes and field-emission cathodes, each of the anodes emitting light in response to electron emission from each of the corresponding cathodes and 2) means for selectively varying field emission between the plurality of corresponding light-emitting anodes and field-emission cathodes to thereby effect an addressable grey-scale operation of the flat panel display.

A further object of the present invention is to provide a display wherein emission between a plurality of corresponding light-emitting anodes and field-emission cathodes is varied by application of a variable electrical potential between selectable ones of the plurality of corresponding light-emitting anodes and field-emission cathodes.

Another object of the present invention is to provide a display wherein emission between a plurality of corresponding light-emitting anodes and field-emission cathodes is varied by applying a switched constant electrical potential between selectable ones of the plurality of corresponding light-emitting anodes and field-emission cathodes.

Yet another object of the present invention is to provide a display wherein a constant electrical potential is pulse width modulated to provide an addressable grey-scale operation of the flat panel display.

A further primary object of the present invention to provide a flat panel display comprising 1) a plurality of light-emitting anodes excited in response to electrons emitted from a corresponding one of a plurality of field-emission cathodes and 2) a circuit for electrically exciting a particular corresponding cathode and anode pair by changing an electrical potential of both the cathode and the anode of the pair.

A further object of the present invention is to provide a display wherein the plurality of cathodes is divided into cathode subdivisions.

Another object of the present invention is to provide a display wherein the plurality of anodes is divided into anode subdivisions.

Yet another object of the present invention is to provide a display wherein each of the cathode subdivisions are independently addressable.

Still another object of the present invention is to provide a display wherein each of the anode subdivisions are independently addressable.

Still yet another object of the present invention is to provide a display wherein the cathode subdivisions are addressable in various combinations to allow a grey scale operation of the cathodes.

And another object of the present invention is to provide a display wherein the anode subdivisions are addressable in various combinations to allow a grey scale operation of the anodes.

Another object of the present invention is to provide a display wherein the cathode subdivisions are of various sizes.

Yet another object of the present invention is to provide a display wherein the anode subdivisions are of various sizes.

Still another object of the present invention is to provide a display wherein the sizes of the cathode subdivisions are related to one another by powers of 2.

Still yet another object of the present invention is to provide a display wherein the sizes of the anode subdivisions are related to one another by powers of 2.

And another object of the present invention is to provide a display wherein the plurality of anodes comprise phosphor strips.

Another object of the present invention is to provide a display wherein each of the plurality of cathodes comprises:

a substrate;

an electrically resistive layer deposited over the substrate; and a layer of material having a low effective work-function deposited over the resistive layer.

Yet another object of the present invention is to provide a display wherein the plurality of anodes and the plurality of cathodes are continuously separated during operation by an electrical potential provided by a diode biasing circuit.

Still another object of the present invention is to provide a display wherein a particular corresponding cathode and anode pair is activated in response to application of a total electrical potential equal to a sum of the electrical potential provided by the diode biasing circuit and an electrical potential provided by a driver circuit.

Still yet another object of the present invention is to provide a display wherein the electrical potential provided by the driver circuit is substantially less than the electrical potential provided by the diode biasing circuit.

In the attainment of the foregoing objects, the preferred embodiment of the present invention is a system for implementing a grey scale in a flat panel display, the system comprising 1) a plurality of field emission cathodes arranged in rows, 2) a plurality of light emitting anodes arranged in columns, each column subdivided into sub-columns, the anodes responsive to electrons emitted from the cathodes, 3) a circuit for joining the rows of cathodes and the columns of anodes to form a pattern of pixels and 4) a circuit for independently and simultaneously addressing a cathode row and a combination of anode subcolumns within an anode column to thereby produce various levels of pixel intensity.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and the specific embodiment disclosed may be readily used as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE INVENTION

Figure 1:
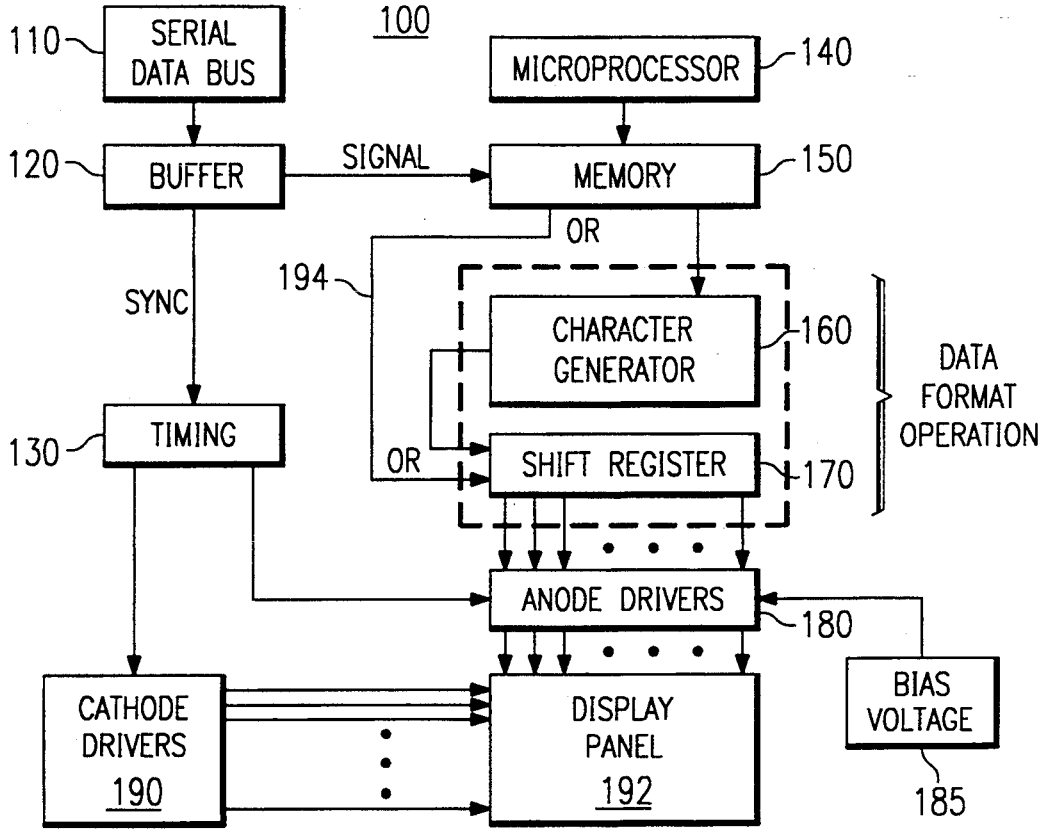
FIG. 1 is a schematic block diagram of a diode flat panel display system, including an addressing scheme employed by the preferred embodiment of the invention.

Referring to FIG. 1, there is shown a schematic of a typical system 100 for implementing the matrix-addressed flat panel display of the present invention. Typically, data representing video, video graphics or alphanumeric characters arrives into the system 100 via the serial data bus 110 where it is transferred through a buffer 120 to a memory 150. The buffer 120 also produces a synchronization signal which it passes on to the timing circuit 130.

A microprocessor 140 controls the data within the memory 150. If the data is video and not information defining alphanumeric characters, it is passed directly to the shift register 170 as bit map data as represented by flow line 194. The shift register 170 uses the received bit map data to actuate the anode drivers 180. As shown in FIG. 1, a voltage driver 185 supplies a bias voltage to the anode drivers 180 in a manner which will be explained in more detail in conjunction with a description of FIG. 3.

If the data arriving into the system 100 consists of alphanumeric characters, the microprocessor 140 transfers this data from the memory 150 into the character generator 160 which feeds the requisite information defining the desired character to a shift register 170 which controls operation of the anode driver 180. The shift register 170 also performs the task of refreshing the images presented to the display panel 192.

The anode drivers 180 and cathode drivers 190 receive timing signals from the timing circuit 130 in order to synchronize operation of the anode driver 180 and cathode drivers 190. Only the anode drivers 180 are concerned with the actual data and corresponding bit map images to be presented by the display panel 192. The cathode drivers are simply concerned with providing synchronization with the anode drivers 180 to provide the desired image on the display panel 192.

In an alternative embodiment of the system 100 shown in FIG. 1, the serial data bus 110 simply determines the mode of presentation on the display panel 192, such as screen resolution, color, or other attributes. For example, the buffer 120 would use this data to provide the proper synchronization signal to the timing circuit 130 which would then provide timing signals to the anode drivers 180 and the cathode drivers 190 in order to provide the correct synchronization for the image to be displayed. The microprocessor 140 would provide the data to be presented to the memory 150 which would then pass on any video or video graphics data to the shift register 170, or transfer alphanumeric data to the character generator 160. The shift register 170, anode drivers 180 and cathode drivers 190 would operate as previously described to present the proper images onto the display panel 192.

Figure 2:
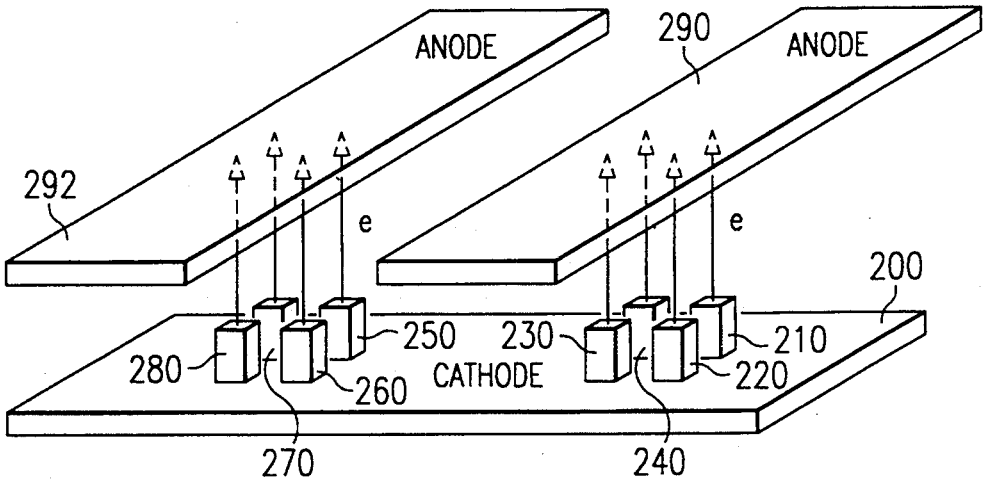
FIG. 2 shows a cathode having multiple field emitters for each pixel.
Figure 13:
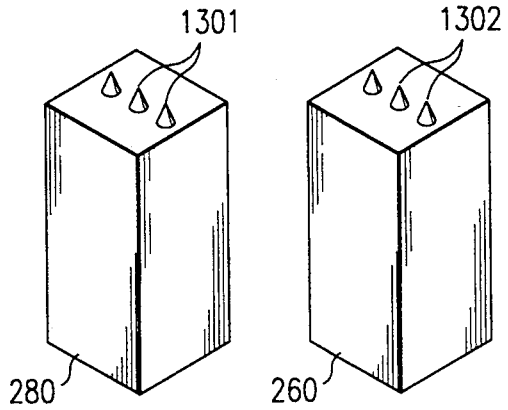
FIG. 13 illustrates micro-tipped emission surfaces on a plurality of cathodes a illustrated in FIG. 2.

Referring next to FIG. 2, there is shown a typical operation of an embodiment of the present invention at two pixel sites. A cathode strip 200 contains multiple field emitters 210, 220, 230, 240 and emitters 250,260,270,280 for each pixel, respectively. This design reduces the failure rate for each pixel, which increases the lifetime of the display and manufacturing yield. Since each emitter 210, 220, 230, 240 and emitters 250, 260, 270, 280 for each pixel has an independent resistive layer, the rest of the emitters for the same pixel will continue to emit electrons if one of the emitters on the pixel fails. For example, if field emitter 230 fails, anode strip 290 will continue to be excited by electrons at the site occupied by the crossing of anode strip 290 and cathode strip 200 since field emitters 210, 220 and 240 remain. This redundancy will occur at each pixel location except for the highly unlikely occurrence of all field emitters failing at a pixel location. For example, field emitters 250, 260, 270 and 280 would all have to fail in order for the pixel location at the crossing of anode strip 292 and cathode strip 200 to become inoperable. FIG. 13 illustrates field emitters 260 and 280 having formed thereon micro-tipped emission surfaces 1302 and 1301, respectively, which have been either randomly or photo-lithographically fabricated, as is disclosed in U.S. Pat. No. 5,015,912, reference above. It is noted that the top surface of emitters 260 and 280 remain substantially flat.

As previously mentioned, one way to reduce field emission variation is to employ current-limiting cathode/anode drivers. Such drivers are commercially available (voltage driver chips such as Texas Instruments device numbers 755, 777 and 751, 516). In current-limiting drivers, as long as the operating voltage of the driver exceeds the voltage required to cause the cathode/anode pair having the highest threshold emission voltage to activate, all cathode/anode pairs will emit with the same operating current/voltage Q point.

Figure 3:
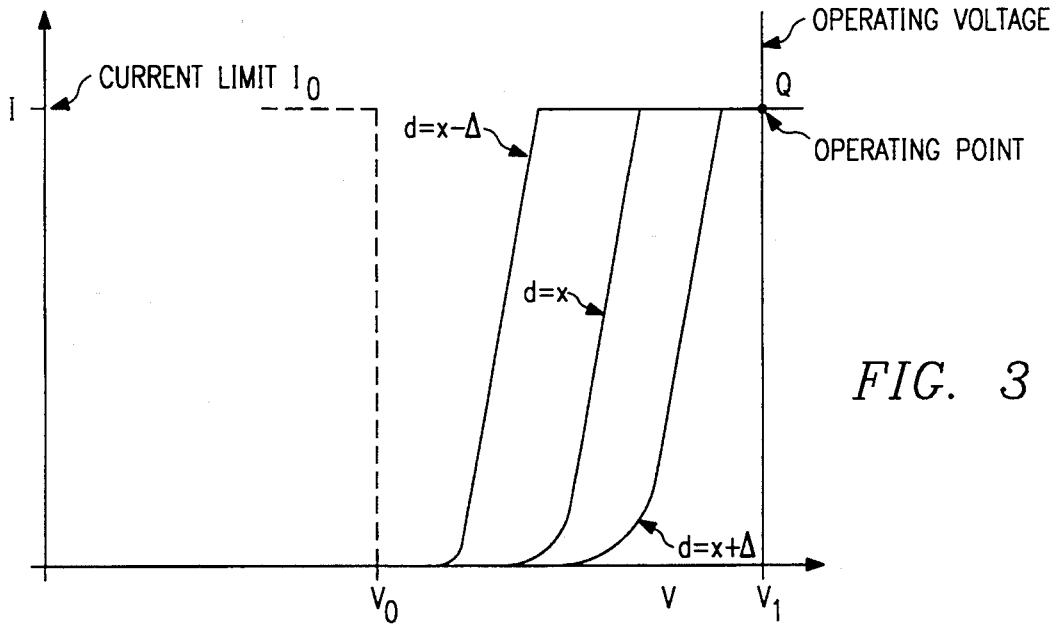
FIG. 3 shows a current-voltage curve for operation of a diode flat panel display.

For an example of the principle of this method, FIG. 3 shows a current-voltage curve for a diode display. The voltage $V_0$ may be a voltage in which the drivers are biased. By changing from $V_0$ to $V_1$, display brightness or intensity can be changed. Similarly, 10 can be changed to adjust display brightness or intensity. The manner of coupling the current-limiting drivers to the display will be described in connection with FIG. 5.

Figure 4:
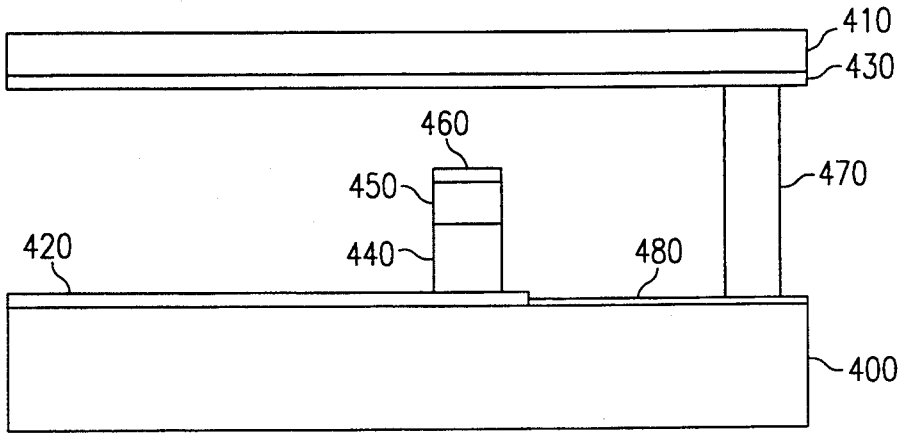
FIG. 4 shows a first method for providing proper spacing in a diode flat panel display.

Turning now to FIG. 4, and as mentioned earlier, according to F-N theory, the current density of field emissions changes by as much as 10 percent when cathode/anode separation changes by only 1 percent. One method employable to reduce this variation is to interpose a resistive element between each cathode and its corresponding cathode conductor as described in Ser. No. 07/851,701, now abandoned. Unfortunately, interposing the resistive element can result in a voltage drop across the resistive element, with a corresponding power dissipation, thereby increasing overall power consumption of the display. Sometimes the added power consumption is acceptable.

FIG. 4 illustrates an arrangement employing a resistive element in a cathode to reduce field variations. Also shown is a first method for providing proper spacing in a diode flat panel display. Shown in FIG. 4 is a cathode substrate 400. Upon the cathode substrate 400 rests a cathode conductive layer 420, a conductive pillar 440, a resistive element 450 and an emission material 460 having a low effective work-function.

A low effective work-function material is any material which has a threshold electric field less than 50 Megavolts per meter ("MV/m"). Examples of low effective work-function material include amorphic diamond (defined as a non-crystalline carbon prepared without hydrogen and having diamond-like properties as described in Collins et al., The Texas Journal of Science, vol. 41, no. 4, 1989, "Thin Film Diamond" pp. 343–58), cermets (defined as any of a group of composite materials made by mixing, pressing and sintering metal with ceramic or by thin film deposition technology, such as graphite-diamond, silicon-silicon carbide and tri-chromium monosilicide-silicon dioxide) or coated micro-tips (which have been either randomly or photo-lithographically fabricated).

In addition, in FIG. 4, there is provided an anode substrate 410 upon which is deposited a cathodoluminescent layer 430. A pillar 470 maintains a proper spacing between the emission material 460 and the cathodoluminescent layer 430. In the preferred embodiment of the invention, the cathode substrate 400 is glass, the cathode conductive layer 420 is a metal tracing, such as copper, the conductive pillar 440 is copper, the emission material 460 is amorphic diamond thin film, the anode substrate is 410 is glass, the cathodoluminescent layer 430 is ITO and the pillar 470 is a dielectric material.

In a diode display, a pillar must have a breakdown voltage much larger than the electron extraction field for the cathode. In the case of a cathode constructed of amorphic diamond film, the electron extraction field is on the order of 15–20 MV/m. But, in a diode field emission display, it has been found that pillars have a breakdown voltage on the order of 5 MV per meter. This is attributed to electron-induced conductivity occurring on the surface of the pillar. Accordingly, as shown conceptually in FIG. 4, a goal of successful spacing is to increase the surface distance from the cathode to the anode so as to minimize the effects of electron-induced conductivity. Specifically, for current to travel from the cathode to the anode via the pillar, the current must traverse a circuitous path along surface 480 in FIG. 4. In the structure shown in FIG. 4, the cathode and anode conductors are separated by 100 microns, while the emission surface of the cathode and the anode conductor are separated by 20 microns.

Figure 5:
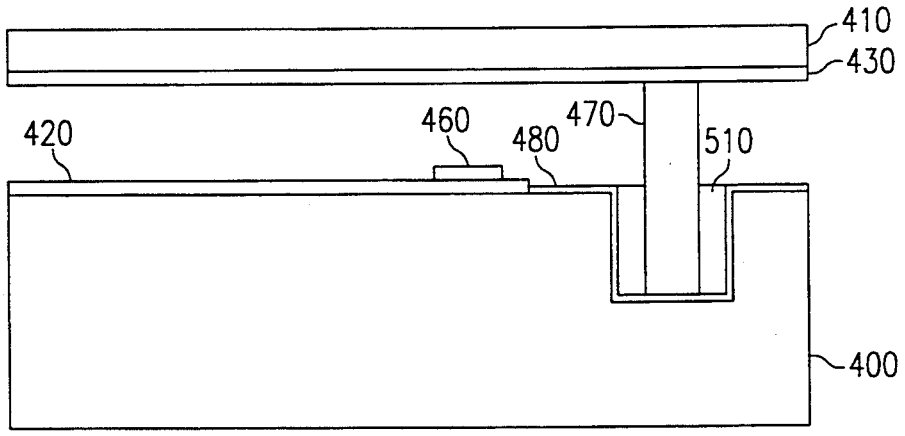
FIG. 5 shows a second method for providing proper spacing in a diode flat panel display employed in the preferred embodiment of the present invention.

Turning now to FIG. 5, shown is a second method for providing proper spacing in a diode flat panel display which is employed in the preferred embodiment of the present invention. The second method is preferable to that detailed in FIG. 4 because it calls for only 1000–2000 spacers in a typical flat panel display, as opposed to 200,000–1,000,000 pillars as required in the first method. In the method shown in FIG. 5, a spacer 470 is located within a recess 510 in the cathode substrate 400. The spacer 470 can be constructed of tungsten, molybdenum, aluminum, copper, or other metals. The spacer 470 can be conductive because the surface 480 separating the emission material 460 from the cathodoluminescent layer 430 is great, thereby discouraging electron-induced conduction. The spacer 470 may also be constructed of an insulating material, such as silicon dioxide. To provide this increased surface distance, the cathode substrate 400 is provided with a plurality of small recesses 510 (on the order of 25–50 microns in diameter and 75–250 microns deep which are used to receive the spacers). The recesses can be made at a spacing of 0.5 cm and preferably reside between individual cathode and anode stripes. In the structure shown in FIG. 5, the cathode and anode conductors 420, 430 are separated by 20 microns, and the emission material 460 and the anode conductive layer 430 are separated by roughly the same distance. Spacers are preferably 30 microns in diameter.

Figure 6:
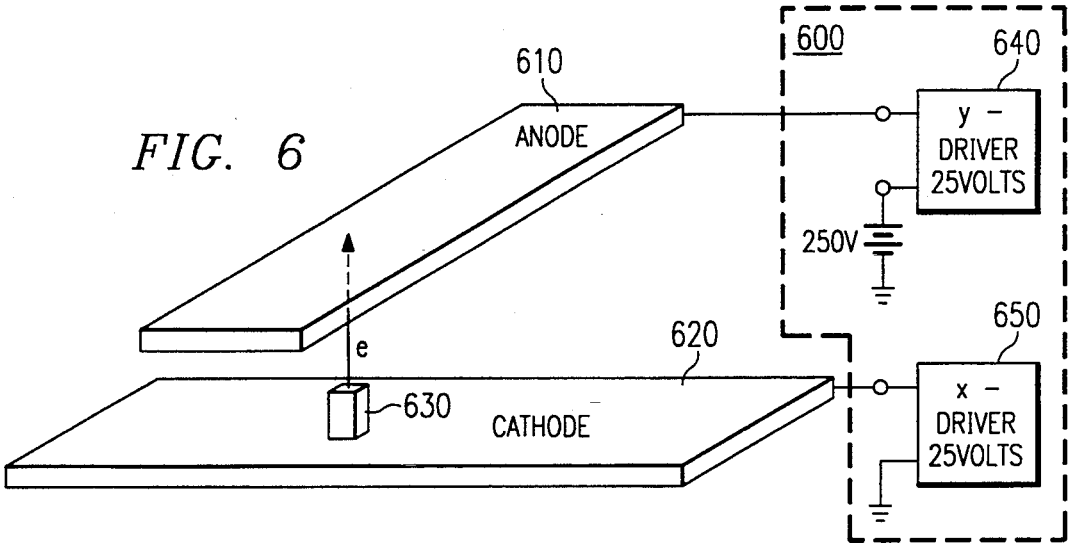
FIG. 6 shows a diode biasing circuit with voltage drivers for the anode and cathode.

Referring now to FIG. 6, a diode biasing circuit 600 is used to drive the display 192 with the operating voltage at a threshold potential required by the low effective work-function material deposited on the cathode. This threshold voltage is applied between an anode strip 610 and a cathode strip 620 resulting in electrons being emitted from a field emitter 630 to the anode 610. For full color display, the anode 610 is patterned in three sets of stripes, each covered with a cathodoluminescent material. Pixels are addressed by addressing a cathode 620 which is perpendicular to a corresponding anode strip 610. The cathode strip 620 is addressed by a 25 volt driver 650 and the anode strip 610 is driven by another 25 volt driver 640 which is floating on a 250-volt DC power supply. The output voltage of 250 volts from the DC power supply is chosen to be just below the threshold voltage of the display. By sequential addressing of these electrodes an image (color or monochrome) can be displayed. These voltages given are only representative and may be replaced by other various combinations of voltages. Additionally, other thin film cathodes may require different threshold potentials for field emission.

Figure 7:
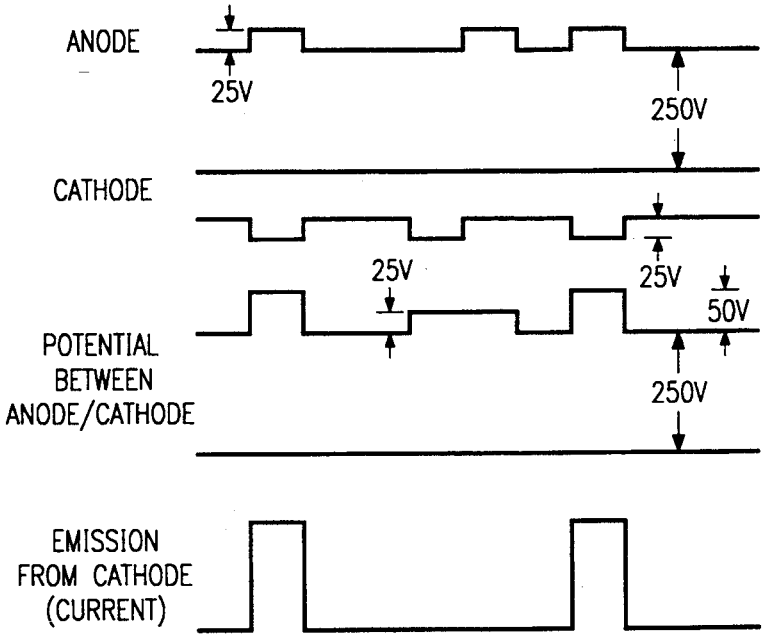
FIG. 7 is a diagram of the potential required between an anode and a cathode to result in emission at an addressed pixel.

FIG. 7 illustrates how emission from a cathode is obtained at a pixel location by addressing the cathode strips and anode strips within the display using the voltage drivers 640, 650.

Figure 8:
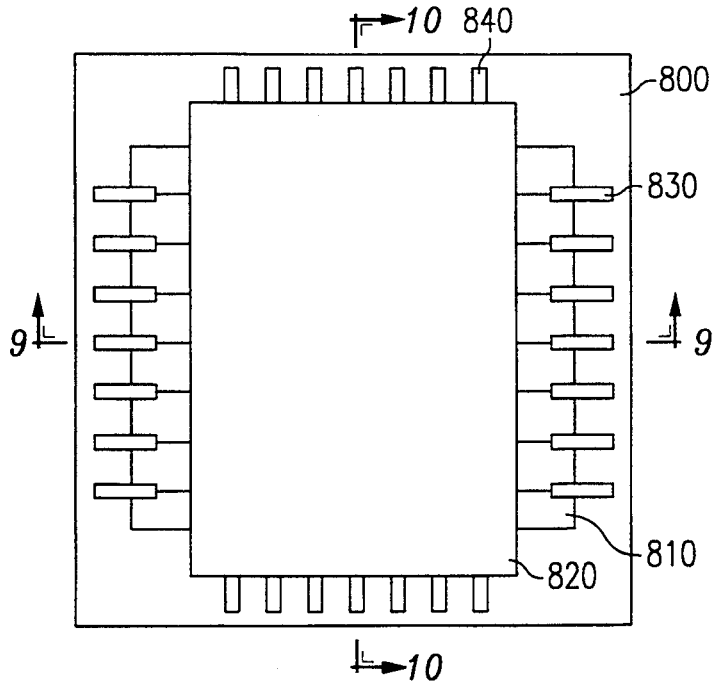
FIG. 8 is an illustration of the anode and cathode assemblies on a printed circuit board.

Referring now to FIG. 8, a top view of the flat panel display 192 illustrates the basic anode-cathode structure used to accomplish the matrix addressing scheme for presenting images onto the display 192. An anode assembly 820 is joined with a cathode assembly 810 in a perpendicular relationship, as illustrated in FIGS. 2 and 6, upon a printed circuit board (PCB) 800 or other suitable substrate. Typical semiconductor mounting technology is used to provide external contacts 830 for the cathode assembly and external contacts 840 for the anode assembly.

As mentioned earlier, one of the best ways to reduce field variation is to employ a combination of resistive elements and current-limiting drivers. In this case, the drivers are used to control the total current delivered to the display, while individual resistive elements are used to minimize variation in field intensity between the various cathode/anode pairs (or within portions of cathode/anode pairs). The resistive elements further help to limit current in case a particular cathode/anode pair shorts together (such that there is no gap between the cathode and the anode). In FIG. 8, current-limiting drivers (not shown), each have a plurality of voltage outputs coupled in a conventional manner to the contacts 830, 840 to thereby provide the contacts 830, 840 with appropriate voltages to control the display. These current-limiting voltage drivers limit current delivery to the contacts 830,840 in a manner described in FIG. 3.

Figure 9:
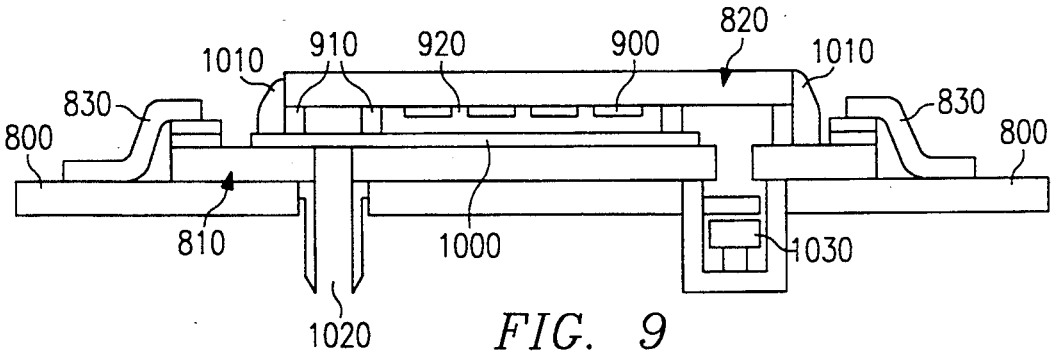
FIG. 9 is cross-section of FIG. 8 illustrating the anode strips.

Turning now to FIG. 9, which shows cross-section 9—9 of the display panel 192 of FIG. 8, the PCB 800 is used to mount the cathode assembly 810 and anode assembly 820 using technology well known in the art. The cathode assembly 620 in FIG. 6 illustrates one row of a cathode strip 1000 which is shown in more detail in FIG. 11. The cathode strip 1000 is accessed electrically from the outside by connectors 830. The anode assembly 820 and the cathode assembly 810 are assembled together with a peripheral glass frit seal 1010. Spacers 910 maintain the anode-cathode spacing required for proper emission of electrons. The spacers 910 may be glass fibers or glass balls or may be a fixed spacer implanted by well known deposition technology.

An exhaust tube 1020 is used with a vacuum pump (not shown) to maintain a vacuum in the space 920 between the anode assembly 820 and the cathode assembly 810. After a vacuum inside the panel reaches $10^{-6}$ Tort or lower, the exhaust tube 1020 is closed and the vacuum pump (not shown) is removed. A getter 1030 is used to attract undesirable elements outgassing from the various materials used to construct the display, namely glass and spacer and cathode materials within the space 920. Typically a getter is composed of a material that has a strong chemical affinity for other materials. For example, barium could be introduced in filament form as a filament getter, into the space 920, which is now a sealed vacuum in order to remove residual gases.

Figure 10:
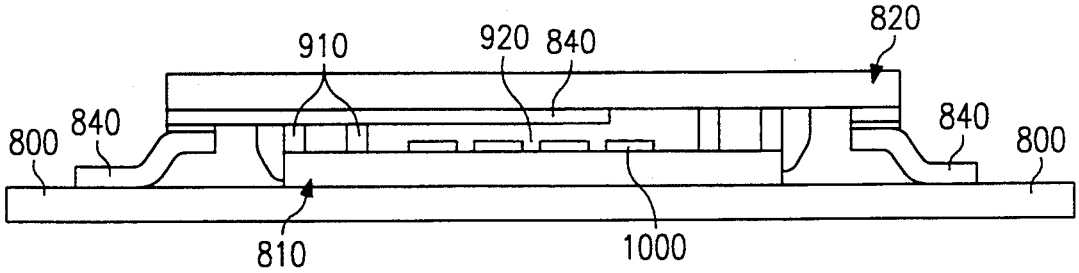
FIG. 10 is cross-section of FIG. 8 illustrating the cathode strips.

Referring next to FIG. 10, there is shown cross-section 10—10 of FIG. 8 which shows in greater detail the rows of cathode strips 1000 in their perpendicular relationship to the anode strips 900. The cathode strips 1000 are spaced sufficiently apart to allow for isolation between the strips 1000. The external connectors 840 to the anode assembly 820 are also shown.

By observing the perpendicular relationship of the anode strips 900 and the cathode strips 1000 in FIGS. 2–10, it can be understood how the present invention allows for matrix addressing of a particular "pixel" within the display panel 192. Pixels are addressed by the system of the present invention as shown in FIG. 1. Anode drivers 180 provide a driver voltage to a specified anode strip 900, and cathode drivers 190 provide a driver voltage to a specified cathode strip 1000. The anode drivers 180 are connected to the anode strip 900 by external connectors 840. The cathode drivers 190 are electrically connected to the cathode strips 1000 by external connectors 830. A particular "pixel" is accessed when its corresponding cathode strip 1000 and anode strip 900 are both driven by their respective voltage drivers. In that instance the driver voltage applied to the anode driver 180 and the driver voltage applied to the cathode driver 190 combine with the DC voltage to produce a threshold potential resulting in electrons being emitted from the cathode strip 1000 to the anode strip 900 which results in light being emitted from the low energy phosphor applied to the anode strip 900 at the particular location where the perpendicularly arranged cathode strip 1000 and anode strip 900 cross paths.

Figure 11:
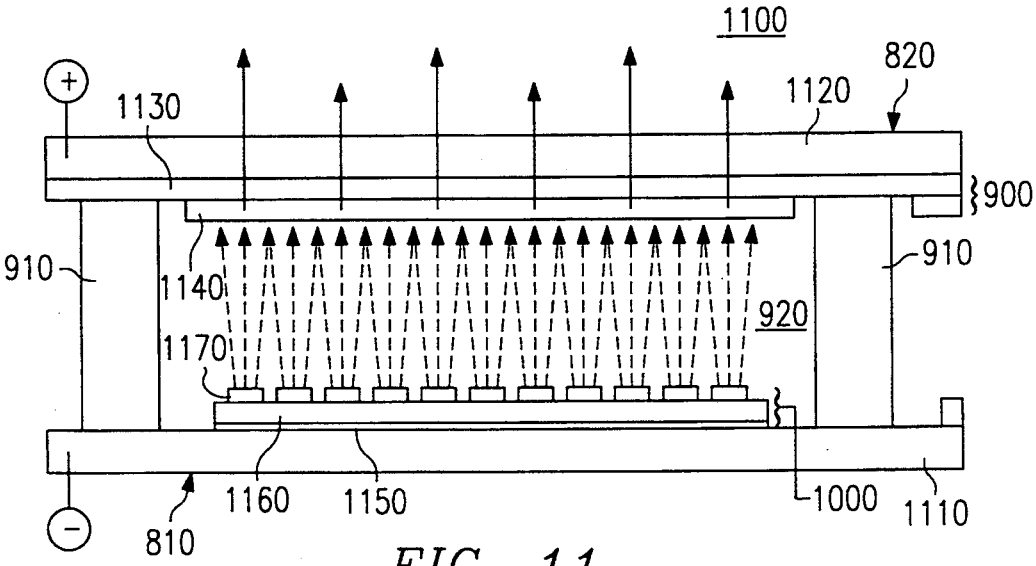
FIG. 11 is a detail of the operation of a pixel within the flat panel display.

Referring now to FIG. 11, there is shown a detailed illustration of a "pixel" 1100. The cathode assembly 810 consists of a substrate 1110, typically glass, a conductive layer 1150, a resistive layer 1160 and the flat cathodes 1170. The conductive layer 1150, resistive layer 1160 and flat cathodes 1170 comprise a cathode strip 1000. The individual flat cathodes 1170 are spaced apart from each other resulting in their isolation maintained by the resistive layer 1160. The anode assembly 820 consists of a substrate 1120, typically glass, a conductive layer 1130, typically ITO and a low energy phosphor 1140, such as ZnO.

The pixel 1100 is illuminated when a sufficient driver voltage is applied to the conductive layer I150 of the cathode strip 1000 associated with the pixel 1100, and a sufficient driver voltage is also applied to the ITO conductive layer 1130 of the anode strip 900 corresponding to that particular pixel 1100. The two driver voltages combine with the constant DC supply voltage to provide a sufficient total threshold potential between the sections of the anode strip 900 and cathode strip 1000 associated with the pixel 1100. The total threshold potential results in electron emission from the flat cathodes 1170 to the low energy phosphor 1140 which emits light as a result.

As may be noted by referring to FIGS. 2 and 11, each cathode strip 1000 employs a multitude of isolated flat cathodes 1170 which illuminates the pixel 1100 even if one or more (but not all) of the flat cathodes 1170 fail since the remaining flat cathodes 1170 will continue to operate.

Figure 12:
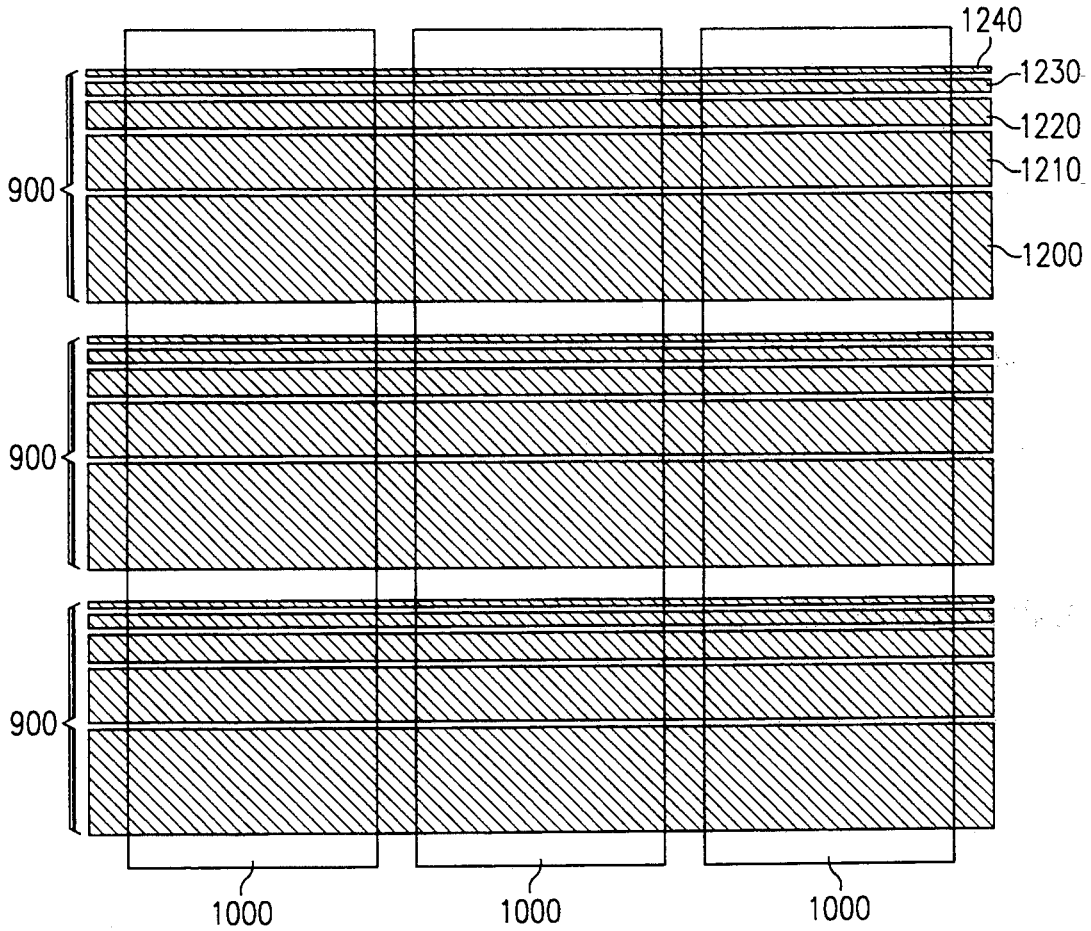
FIG. 12 illustrates subdivision of the anode strips for implementation of a grey scale mode within the display.

Referring now to FIG. 12, there is shown an implementation of a grey scale mode on the flat panel display 192. The cathode strips 1000 are arranged perpendicularly with the anode strips 900. However, each anode strip 900 may be further subdivided into various smaller strips 1200, 1210, 1220, 1230, 1240 of equal or different widths. Each subdivision is isolated from the adjacent subdivision by a sufficient gap to maintain this isolation. The individual subdivided strips 1200, 1210, 1220, 1230, 1240 are independently addressable by the anode drivers 180. The result is that a pixel 1100 may be illuminated in a grey scale mode. For example, if subdivisions 1200 and 1230 are applied a driver voltage by their corresponding anode drivers 180, and subdivisions 1210, 1220 and 1240 are not given a driver voltage, then only the low energy phosphor associated with subdivisions 1200 and 1230 will be activated by the corresponding cathode strip 1000 resulting in less than maximum illumination of the pixel 1100.

As can be seen, the subdivisions 1200, 1210, 1220, 1230, 1240 may be activated in various combinations to provide various intensities of illumination of the pixel 1100. The individual subdivided strips are of various sizes which are related to one another by powers of 2. If, for instance, there are 5 strips having relative sizes of 1, 2, 4, 8 and 16, and activation of individual strips proportionately activates a corresponding pixel, then activation of the pixel can be made in discrete steps of intensity from 0 to 32 to thereby produce a grey scale. For example, if a pixel intensity of 19 is desired, the strips sized 16, 2 and 1 need to be activated.

From the above, it is apparent that the present invention is the first to provide a flat panel display comprising 1) a cathode assembly having a plurality of cathodes, each cathode including a layer of cathode conductive material and a layer of a low effective work-function material deposited over the cathode conductive material and 2) an anode assembly having a plurality of anodes, each anode including a layer of anode conductive material and a layer of cathodoluminescent material deposited over the anode conductive material, the anode assembly located proximate the cathode assembly to thereby receive charged particle emissions from the cathode assembly, the cathodoluminescent material emitting light in response to the charged particle emissions.

Although the present invention and its advantages have been described in detail, it should be understood that various changes, substitutions and alterations can be made herein without departing from the spirit and scope of the invention as defined by the appended claims.

What is claimed is:

1. A diode structure flat panel display, comprising:

a cathode assembly having a plurality of cathodes, each cathode including a layer of cathode conductive material and a layer of a low effective work-function material disposed over said cathode conductive material; and an anode assembly having a plurality of anodes, each anode including a layer of anode conductive material layer of cathodoluminescent material disposed over said anode conductive material, said anode assembly located proximate said cathode assembly to thereby receive charged particle emissions from said cathode assembly, said cathodoluminescent material emitting light in response to said charged particle emissions.

2. The display as recited in claim 1 wherein said plurality of cathodes have a relatively flat emission surface comprising said low effective work-function material arranged to form a plurality of micro-crystallites.

3. The display as recited in claim 2 wherein said micro-crystallites function as charged particle emission sites.

4. The display as recited in claim 3 wherein said emission sites contain dopant atoms.

5. The display as recited in claim 4 wherein said dopant atom is carbon.

6. The display as recited in claim 3 wherein said emission sites contain of an element different from said low effective work-function material.

7. The display as recited in claim 3, wherein said charged particle emission sites are located on said relatively flat emission surface a distance away from any edges of said relatively flat emission surface.

8. The display as recited in claim 1 wherein said plurality of cathodes have micro-tipped emission surfaces.

9. The display as recited in claim 8 wherein said plurality of cathodes are randomly fabricated.

10. The display as recited in claim 8 wherein said plurality of cathodes are photolithographically fabricated.

11. The display as recited in claim 1 wherein said low effective work-function material is amorphic diamond film.

12. The display as recited in claim 1 wherein said display comprises only two terminals located proximate to said charged particle emissions, selected ones of said cathodes constituting one such terminal and corresponding selected ones of said anodes constituting the other such terminal.

13. The display as recited in claim 1 wherein electrical potentials which control said charged particle emissions are applied solely from selected corresponding ones of said cathodes and anodes.

14. A diode structure flat panel display, comprising:

a cathode assembly having a plurality of cathodes, each cathode including a layer of cathode conductive material and a layer of a low effective work-function material disposed over said cathode conductive material;

an anode assembly having a plurality of anodes, each anode including a layer of anode conductive material and a layer of cathodoluminescent material disposed over said anode conductive material; and means for maintaining a relatively constant gap between said cathode and anode assemblies.

15. The display as recited in claim 14 wherein said gap maintaining means comprises a plurality of spacers.

16. The display as recited in claim 15 wherein each of said spacers corresponds with ones of said pluralities of cathodes and anodes.

17. The display as recited in claim 16 wherein said cathode assembly further comprises a cathode substrate under said cathode conductive material.

18. The display as recited in claim 17 wherein said cathode conductive material contains a plurality of recesses in a surface proximate said anode assembly.

19. The display as recited in claim 18 wherein said plurality of spacers are spaced-apart from said plurality of cathodes.

20. The display as recited in claim 19 wherein said recesses are adapted to receive said spacers.

21. A flat panel display, comprising:

a cathode assembly having a plurality of cathodes, each cathode including a layer of cathode conductive material and a layer of low effective work-function material disposed over said cathode conductive material, wherein said cathode assembly further comprises a cathode substrate under said cathode conductive material;

an anode assembly having a plurality of anodes, each anode including a layer of anode conductive material and a layer of cathodoluminescent material disposed over said anode conductive material; and means for maintaining a relatively constant gap between said cathode and anode assemblies, wherein said gap maintaining means comprises a plurality of spacers, wherein each of said spacers corresponds with ones of said pluralities of cathodes and anodes, and wherein said plurality of spacers are spaced-apart from said plurality of cathodes, wherein said cathode conductive material contains a plurality of recesses in a surface proximate said anode assembly, wherein said recesses are adapted to receive said spacers, and wherein said recesses and said spacers form a circuitous path to thereby minimize electron-induced conduction between said plurality of cathodes and anodes.

22. A diode structure flat panel display, comprising:

a cathode assembly having a plurality of cathodes, each cathode including a layer of cathode conductive material and a layer of a low effective work-function material disposed over said cathode conductive material;

an anode assembly having a plurality of anodes, each anode including a layer of anode conductive material and a layer of cathodoluminescent material disposed over said anode conductive material, said anode assembly located proximate said cathode assembly to thereby receive charged particle emissions from said cathode assembly, said cathodoluminescent material emitting light in response to said charged particle emissions; and means for maintaining a relatively constant gap between said cathode and anode assemblies, wherein said gap maintaining means comprises a plurality of spacers, and wherein said spacers form a circuitous path to thereby minimize electron-induced conduction between said plurality of cathodes and anodes.

23. A diode structure flat panel display, comprising:

a cathode assembly having a plurality of cathodes, each cathode including a layer of cathode conductive material and a layer of a low effective work-function material disposed over said cathode conductive material, wherein said cathode assembly further comprises a cathode substrate under said cathode conductive material;

an anode assembly having a plurality of anodes, each anode including a layer of anode conductive material and a layer of cathodoluminescent material disposed over said anode conductive material; and means for maintaining a relatively constant gap between said cathode and anode assemblies, wherein said gap maintaining means comprises a plurality of spacers, wherein each of said spacers corresponds with ones of said pluralities of cathodes and anodes, wherein said cathode conductive material contains a plurality of recesses in a surface proximate said anode assembly, wherein said plurality of spacers are spaced-apart from said plurality of cathodes, wherein said recesses are adapted to receive said spacers, wherein said recesses are formed within said cathode substrate so that said spacers have lengths greater than said gap between said cathode and anode assemblies, and wherein said recesses and said spacers form a circuitous path to thereby minimize electron-induced conduction between said plurality of cathodes and anodes.

* * * * *

UNITED STATES PATENT AND TRADEMARK OFFICE

CERTIFICATE OF CORRECTION

PATENT NO. : 5,449,970

DATED : Sep. 12, 1995

INVENTOR(S) : Kumar et al.

It is certified that error appears in the above-indentified patent and that said Letters Patent is hereby corrected as shown below:

Column 10, line 7: Delete "755, 777" and substitute --755,777-- therefor.

Column 10, line 7: Delete "755, 516" and substitute --751,516-- therefor.

Column 12, line 34: Delete "830,840" and insert --830, 840-- in its place.

Column 12, line 54: Delete "Tort" and insert --Torr-- in its place.

Column 13, line 41: Delete "I150" and insert --1150-- in its place.

Column 14, line 53: Insert --and a-- immediately before the words "layer of".

Column 15, line 4: Insert --dopants-- between the words "contain" and "of an element".

Signed and Sealed this

Nineteenth Day of March, 1996

*Attest:*

Bruce Lehman

BRUCE LEHMAN

*Attesting Officer*

*Commissioner of Patents and Trademarks*